US005204502A

United States Patent [19]

Ferris et al.

[11] Patent Number: 5,204,502

[45] Date of Patent: Apr. 20, 1993

[54] DUAL FUNCTION SWITCHING APPARATUS

[75] Inventors: Glenn E. Ferris, Fishers; Mark Z. Rada; Frederick T. Yager, both of Kokomo, all of Ind.

[73] Assignee: Delco Electronics Corporation, Kokomo, Ind.

[21] Appl. No.: 783,597

[22] Filed: Oct. 28, 1991

[51] Int. Cl.[5] ..... H01H 9/00

[52] U.S. Cl. ..... 200/4; 200/18; 200/313

[58] Field of Search ..... 200/4, 11 J, 11 K, 16 C, 200/18, 52 R, 313, 314, 316, 504, 526, 527, 11 E, 11 EA, 11 G

[56] References Cited

U.S. PATENT DOCUMENTS

| | | | |
|---|---|---|---|
| 2,576,836 | 11/1951 | Hilsinger, Jr. | 200/4 |
| 3,952,176 | 4/1976 | Holder et al. | 200/11 |
| 3,983,348 | 9/1976 | Kellogg | 200/314 |
| 4,164,633 | 8/1979 | Sheridan et al. | 200/4 |
| 4,175,221 | 11/1979 | Kellogg | 200/4 |
| 4,264,799 | 4/1981 | Aspden | 200/327 |
| 4,659,880 | 4/1987 | Kondo et al. | 200/5 |
| 4,724,286 | 2/1988 | Cummins | 200/4 |
| 4,866,219 | 9/1989 | Riding et al. | 200/4 |

*Primary Examiner*—Jeffrey A. Gaffin
*Assistant Examiner*—Michael A. Friedhofer
*Attorney, Agent, or Firm*—Mark A. Navarre

[57] ABSTRACT

A switching apparatus providing both linear momentary and rotary switching, including a carrier element disposed within a switch housing and activated by the rotation or linear displacement of an operator manipulated button. The carrier is supported on a central transparent shaft which pipes light to a button-mounted indicator from a lamp disposed behind the switch apparatus. The carrier element supports rotary and linear contact rings in relation to a coplanar set of stationary contacts formed on the bottom of the housing. The rotary contact ring is resiliently biased into engagement with the stationary contacts, and is keyed to the carrier element for rotation therewith, defining a rotary travel switch. The linear contact ring is resiliently biased away from the stationary contacts and into engagement with a shoulder formed on the carrier element shaft, defining a linear travel momentary contact switch. Pyramidal indentations and protuberances formed on the interior periphery of the housing cooperate with a simple detent ball/spring assembly to provide both detent positions for the rotary switch and tactile feedback for the linear switch.

10 Claims, 2 Drawing Sheets

DUAL FUNCTION SWITCHING APPARATUS

This invention relates to a dual function switching apparatus, and more particularly, to an apparatus which provides both linear travel momentary switching and rotary travel detent switching.

BACKGROUND OF THE INVENTION

In an effort to improve space utilization in automotive and other control panels, it has been proposed to combine two or more switching functions within a single switch housing. In automotive radios, for example, it is common to provide combined linear travel momentary switching for mode selection (AM/FM, for example) and rotary travel switching for tuning or volume control. The use of such switches in automotive climate control is also known.

In general, multi-function switches tend to be ganged or modular assemblies, and as such, fail to take advantage of the potential synergies due to commonality of components. For example, the momentary and rotary contact assemblies and detent mechanisms are typically provided with separate redundant structures. Also, it is often desirable to provide a lighted indicator integral with the switch button to indicate the activation of a controlled element.

SUMMARY OF THE PRESENT INVENTION

The present invention is directed to an improved switching apparatus providing both linear and rotary switching, wherein common contact and detent mechanisms are employed to effect part count and cost reductions.

A carrier element disposed within a switch housing and activated by the rotation or linear displacement of an operator manipulated button is supported on a central transparent shaft which pipes light to a button-mounted indicator from a lamp disposed behind the switch apparatus. The carrier element shaft coaxially supports rotary and linear contact rings in relation to a coplanar set of stationary contacts formed on the bottom of the housing. The rotary contact ring is resiliently biased into engagement with the stationary contacts, and is keyed to the carrier element for rotation therewith, defining a rotary travel switch. The linear contact ring is resiliently biased away from the stationary contacts and into engagement with a shoulder formed on the carrier element shaft, defining a linear travel momentary contact switch.

Pyramidal indentations and protuberances formed on the interior periphery of the housing cooperate with a simple detent ball/spring assembly to provide both detent positions for the rotary switch and tactile feedback for the linear switch.

DETAILED DESCRIPTION OF THE DRAWINGS

Figure 1:
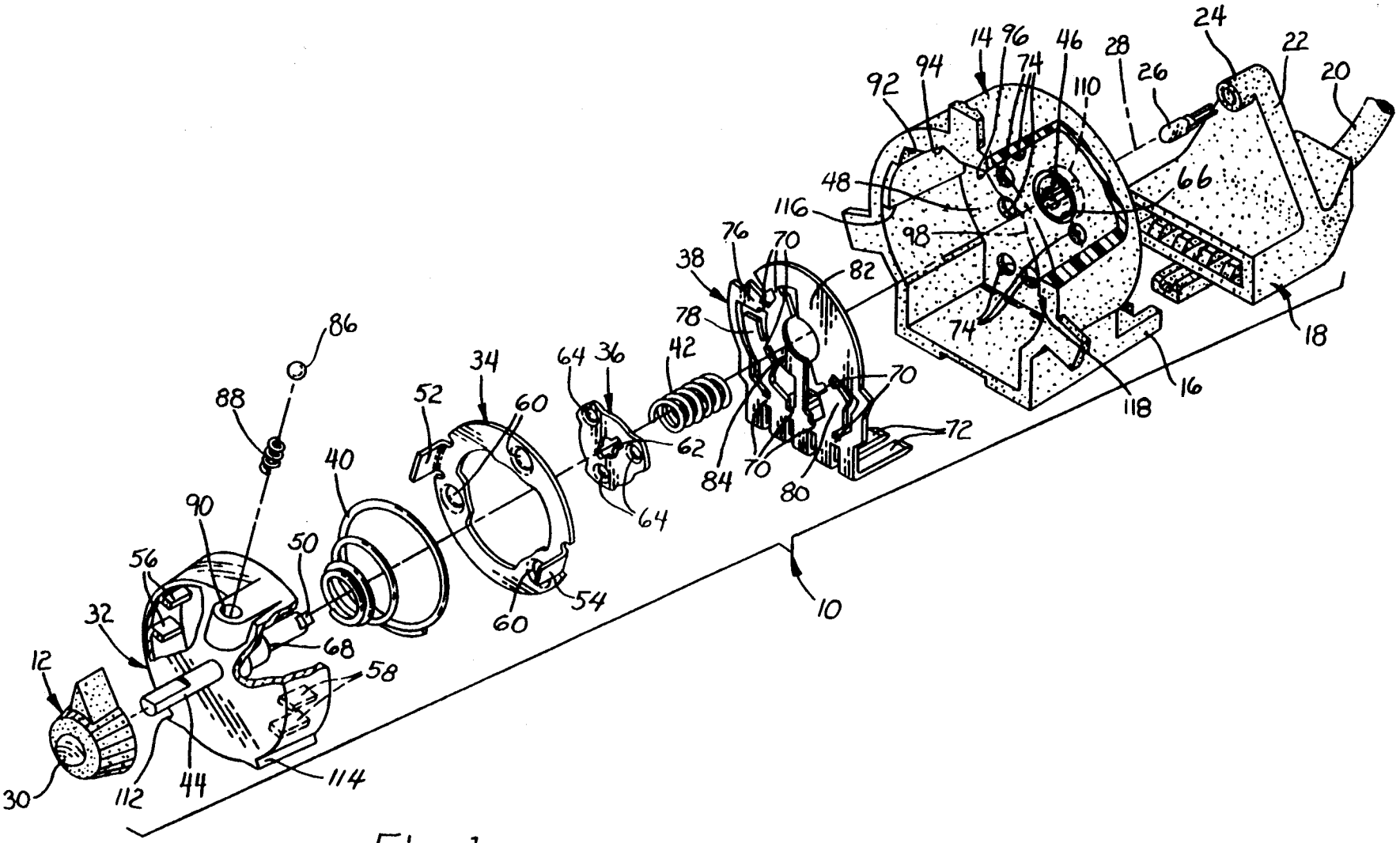
FIG. 1 is an exploded view of the dual function switching apparatus of this invention.

Referring to the drawings, and particularly to FIG. 1, the reference numeral 10 generally designates a switch assembly according to this invention having both linear momentary and rotary switching functions. In each case, the switching function is activated by an operator via button 12. In the illustrated embodiment, the switch assembly 10 is employed in an automotive application in which button 12 is rotated to select a desired fan speed for a heating/ventilation/air conditioning system, and momentarily depressed to activate or deactivate a rear window defog system.

The various elements providing the switching functions are disposed within a molded plastic housing 14 which is designed to be installed on an automotive instrument panel support member 15 (see FIG. 2) such that button 12 protrudes into the vehicle passenger compartment. An electrical terminal block 16 is formed on a rearward extension of the housing 14, and a connector 18 is mechanically secured to the terminal block 16 to form an electrical connection between the switch assembly 10 and a conductor bundle 20. The connector 18 also includes an integral flange 22 and lamp socket 24 for supporting a function indicator lamp 26 on a longitudinal axis 28 of the switch assembly 10. In the illustrated embodiment, the lamp 26 signals activation of the vehicle rear window defog system. When the defog system is activated, light emitted from lamp 26 is transmitted through the switch assembly 10, as described below, to an indicator bezel 30 formed in the center of button 12.

The switch assembly housing 14 supports a number of elements along the longitudinal axis 28, including a cylindrical carrier element 32, rotary contact ring 34, linear contact ring 36, a stationary contact set 38 insert molded into the housing 14, and a pair of springs 40 and 42. The carrier 32 is supported on a transparent shaft 44 which serves the light transmission function referred to above.

Figure 2:
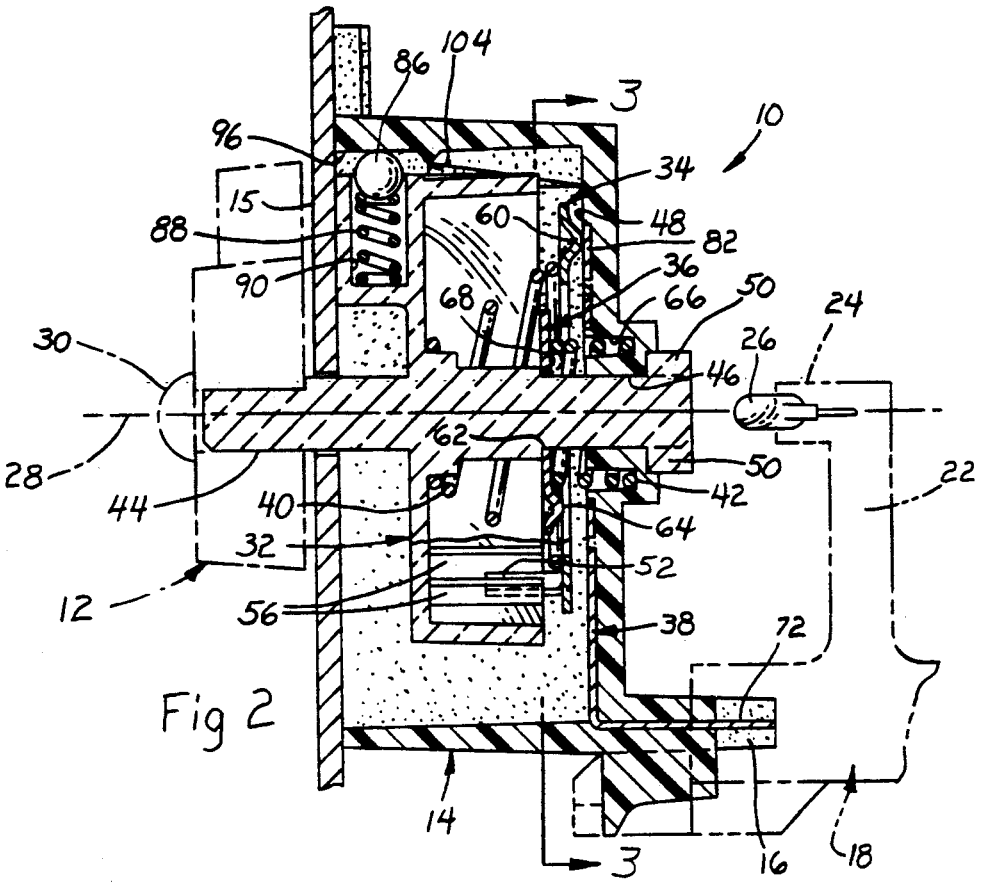
FIG. 2 is a sectioned side view of the assembled switching apparatus of this invention.

The inboard end of shaft 44 is laterally retained in a key-shaped opening 46 formed in the rear face 48 of housing 14. The outboard end of shaft 44 is flatted for attachment to button 12, and upon assembly into the vehicle, is laterally retained by the instrument panel support member 15 as shown in FIG. 2. Prior to attachment of the housing 14 to the support member 15, the carrier 32 is loosely retained by the sides of housing 14. The carrier 32 and other switch assembly elements are longitudinally retained within the housing 14 by a tab 50 formed on the inboard end of shaft 44, as described below.

The rotary contact ring 34 has a large central opening, and is slidingly coupled to the carrier 32 by virtue of the contact ring fingers 52, 54 which are received between pairs of tabs 56, 58 formed on the inner periphery of carrier 32. This coupling ensures that the contact ring 34 rotates with the carrier 32, and hence the button 12, while permitting axial displacement of the carrier 32 with respect to the contact ring 34 when button 12 is momentarily depressed. The face of contact ring 34 is deformed to define a set of three contact bumps 60. The conical spring 40 seats against the inner face of carrier 32, and operates to resiliently bias rotary contact ring 34 so that the contact bumps 60 engage various contacts of the stationary contact set 38.

The linear contact ring 36 is nested within the rotary contact ring 34, and has a central opening 62 for receiving carrier shaft 44. The face of contact ring 36 is deformed to define a set of three contact bumps 64. The spring 42 is seated in an annular recess 66 (see FIG. 2) formed in the rear face of housing 14, and operates to resiliently bias linear contact ring 36 against a shoulder 68 formed on the carrier shaft 44. This maintains the contact bumps 64 out of engagement with the various contacts of the stationary contact set 38 when the button 12 is not depressed. When button 12 is depressed, the contact ring 36 passes axially through the central opening in contact ring 34 as the spring 42 is compressed, and the contact bumps 64 engage the various contacts of stationary contact set 38 to activate an external system. The spring 42, of course, returns the contact ring 34 to its original position when the button 12 is released.

Figure 3:
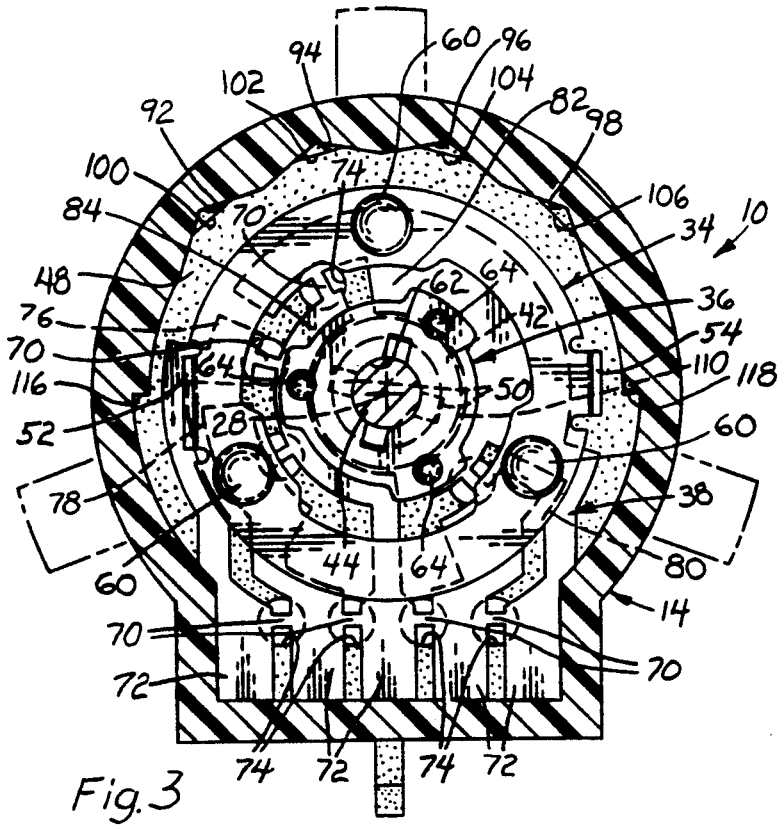
FIG. 3 is a sectioned frontal view of the assembled switching apparatus, taken along the lines 3—3 of FIG. 2.

The stationary contact set 38 is formed integral with the housing 14 by an insert molding process, as indicated above. The various contacts adapted to be engaged by the contact bumps 60 and 64 of contact rings 34 and 36 are initially formed as a single copper element 38, including a number of dispensable legs 70 interconnecting the various contacts. A set of contact terminals 72 integral with the various contacts are adapted to be received within the housing terminal block 16. Following the insert molding process, the dispensable legs 70 are removed via the underlying openings 74 formed in the rear face of housing 14, as seen in the assembled switch 10 of FIGS. 2-3. This leaves behind outer and inner sets of contacts adapted to be engaged by the contact ring bumps 60 and 64, respectively, each contact being connected to a contact terminal 72.

The outer ring of contacts comprises the individual contact areas 76, 78 and 80, and the common contact area 82. These contacts cooperate with the rotary contact ring 34, as noted above, to define one of four unique conditions: (1) contact 76 connected to common contact 82, (2) contact 78 connected to common contact 82, (3) contact 80 connected to common contact 82, (4) common contact 82 open-circuited. In the illustrated embodiment, these conditions define the LO, MED, HI and OFF positions of a blower motor control.

The inner ring of contacts comprises the individual contact area 84 and the common contact area 82. These contacts cooperate with the linear contact ring bumps 64 as noted above to define one of two unique conditions: (1) contact 84 connected to common contact 82, or (2) common contact 82 open-circuited. The contacts 82 and 84 are patterned so that they will be bridged by the bumps 64 upon depression of button 12 regardless of the rotary position of linear contact ring 36. In the illustrated embodiment, the momentary connection of contact 82 to contact 84 via momentary depression of button 12 operates, alternatively, to activate or deactivate the vehicle rear window defog system.

A detent ball 86 and spring 88 loaded into a cavity 90 formed on the outer periphery of carrier 32 cooperate with pyramidal features formed on the inner periphery of housing 14 to provide rotary detent positions for the rotary contact ring 34 and tactile feedback during axial displacement of the linear contact ring 36. The rotary detent positions are established by virtue of the ball 86 being resiliently biased into engagement with the pyramidal housing indentations 92-98, best seen in FIG. 3. As indicated above, these positions correspond to the LO, MED, HI and OFF positions of a blower motor control.

The tactile feedback during axial displacement of the button 12 is provided by virtue of the ball 86 being resiliently biased into engagement with the pyramidal protuberances 100-106, best seen in FIG. 2, formed within each of the pyramidal housing indentations 92-98. As the button 12 is depressed, the ball 86 rides up the outboard ramp of pyramidal protuberance 104. This compresses the spring 88, generating mechanical resistance to the depression of button 12. At approximately 60% travel of the pushbutton 12, the ball 86 travels over the top of the ramp. This causes the actuation force to be reduced by about 30% which provides tactile feedback. Electrical connection is achieved by momentarily bridging the contacts 82 and 84 via contact ring bumps 64.

To assemble the switch 10, contact rings 34, 36 and the springs 40, 42 are assembled within the carrier 32 and retained therein by a retainment element (not shown). The loaded carrier 32 is then inserted into housing 14 so that the tab 50 of carrier shaft 44 passes through the key-shaped housing opening 46. At this installation position, a carrier stop 112 aligns with detent 92. The carrier 32 is then rotated so that the tab 50 is axially retained in a circular recess 110 formed on the rear outer surface of housing 14; see FIGS. 2 and 3. Once so retained, rotary movement of the carrier 32 within housing 14 is mechanically limited via interference between stops 112, 114 formed on the outer periphery of carrier 32 and complementary stops 116, 118 formed on the inner periphery of housing 14; see FIG. 1.

The switch assembly of this invention thus integrates the rotary and linear switch functions, realizing a part count and cost savings, compared to prior composite switch applications. The apparatus utilizes a single stationary contact assembly for both rotary and linear switching functions, and uses common elements to provide rotary detent positioning and linear tactile feedback. The button indicator represents additional functionality in composite switches. Regarding part count, only ten separate parts were required in an actual mechanization of the subject switch apparatus, excluding connector 18 and lamp 26.

While this invention has been described in reference to the illustrated embodiment, it is expected that various modifications will occur to those skilled in the art. For example, further elements could be added to transform the linear travel switch into a two-pole switch instead of a momentary switch. Also, the switch could be employed for numerous other functions in lieu of the disclosed functions. In this regard, it will be understood that switches incorporating such modifications may fall within the scope of this invention, which is defined by the appended claims.

The embodiments of the invention in which an exclusive property or privilege is claimed are defined as follows:

1. Dual function switching apparatus for an instrument panel, comprising:
   - a housing fastened to said panel to form a closed cavity defined in part by said panel and a rear face of said housing;
   - a set of stationary contacts formed in said cavity on the rear face of said housing;
   - a carrier element disposed within said cavity and supported on a shaft having a longitudinal axis, said shaft being supported within said cavity to permit rotation and axial displacement of said carrier element;

rotary and linear contact elements disposed between said carrier element and said stationary contacts;

means for coupling said rotary contact element to said carrier element for rotation therewith, and for biasing said rotary contact element into engagement with said set of stationary contacts, thereby defining a rotary switch assembly actuated by rotation of said carrier element; and means for biasing said linear contact element into engagement with said carrier element, thereby defining a linear travel switch assembly actuated by axial displacement of said carrier element.

2. The apparatus set forth in claim 1, including an operator manipulated button secured to said shaft for effecting rotation and axial displacement of said carrier element.

3. The apparatus set forth in claim 2, wherein said button includes a central transparent portion and said shaft is light transmissive, whereby light emitted from a source in proximity to the rear face of said housing is transmitted through said shaft to said central transparent portion to provide a visual indication to said operator.

4. The apparatus set forth in claim 1, wherein said means for biasing said rotary contact element into engagement with said stationary contacts includes a spring element disposed between said carrier element and said rotary contact element.

5. The apparatus set forth in claim 1, wherein said means for biasing said linear contact element into engagement with said carrier element includes a spring element disposed between said linear contact element and the rear face of said housing.

6. The apparatus set forth in claim 1, wherein said rotary contact element has a central opening, and said linear contact element is adapted to pass through said central opening along said longitudinal axis upon axial displacement of said carrier element.

7. The apparatus set forth in claim 1, wherein said means for coupling said rotary contact element to said carrier element permits relative displacement between said rotary contact element and said carrier element along said longitudinal axis.

8. The switch apparatus set forth in claim 1, wherein said housing includes a side wall disposed between said rear face and said panel, and said carrier element includes a detent element resiliently biased into engagement with pyramidal features formed on said side wall to define detent positions for said rotary switch assembly and tactile feedback for said linear travel switch assembly.

9. The switch apparatus set forth in claim 8, wherein the detent positions for said rotary switch assembly are defined by engagement of said detent element with pyramidal indentations formed in said sidewall.

10. The switch apparatus set forth in claim 8, wherein the tactile feedback for said linear travel switch assembly is defined by engagement of said detent element with pyramidal protuberances formed in said sidewall.

* * * * *